United States Patent [19]

Dapperheld et al.

[11] Patent Number: 4,800,012

[45] Date of Patent: Jan. 24, 1989

[54] ELECTROCHEMICAL PROCESS FOR THE REPLACEMENT OF HALOGEN ATOMS IN AN ORGANIC COMPOUND

[75] Inventors: Steffen Dapperheld, Kriftel; Rudolf Heumüller, Bad Soden am Taunus; Manfred Wildt, Brombachtal, all of Fed. Rep. of Germany

[73] Assignee: Hoechst Aktiengesellschaft, Frankfurt am Main, Fed. Rep. of Germany

[21] Appl. No.: 155,767

[22] Filed: Feb. 16, 1988

[30] Foreign Application Priority Data

Feb. 17, 1987 [DE] Fed. Rep. of Germany ..... 3704915

[51] Int. Cl.[4] ..... C25G 3/00

[52] U.S. Cl. ..... 204/73 R

[58] Field of Search ..... 204/73 R

[56] References Cited

U.S. PATENT DOCUMENTS 3,887,442 6/1975 Gilchrist ..... 204/72

OTHER PUBLICATIONS

Casanova, J. et al., "Electrochemistry of the Carbon-Halogen Bond", in *The Chemistry of the Carbon-Halogen Bond*, Part 2, Ed. S. Patai John Wiley & Sons, London, 1973, pp. 979-1047.

Miller, L. et al., *J. Org. Chem.* 34, 3359-3362 (1969).

Jura, W. H. et al., *J. Amer. Chem. Soc.* 80, 5402-5409 (1958).

*Primary Examiner*—R. L. Andrews

[57] ABSTRACT

The existing processes for the preparation of halogenoacrylic acids and deuterated derivatives thereof have to be carried out using chemicals which are in some cases very toxic or very expensive.

Electrochemical reduction, however, makes it possible to eliminate one or more halogen atoms selectively from halogenoacrylic and halogenomethacrylic acids and derivatives thereof, and to replace these by hydrogen or deuterium atoms.

This is effected by electrolyzing the acids or derivatives thereof in a solution containing water or deuterium oxide at a temperature from −10° C. up to the boiling point of the electrolysis liquid.

9 Claims, No Drawings

ELECTROCHEMICAL PROCESS FOR THE REPLACEMENT OF HALOGEN ATOMS IN AN ORGANIC COMPOUND

Electrochemical process for the replacement of halogen atoms in an organic compound.

The invention relates to an electrochemical process for the replacement of halogen atoms by hydrogen or deuterium atoms in halogeno(meth)acrylic acids and derivatives thereof.

Derivatives of acrylic acid and methacrylic acid have a very wide field of application. As organic intermediates they permit access to a large number of products. Above all, however, they are suitable for the preparation of plastics.

For some time halogenated and deuterated acrylic and methacrylic acid derivatives have been of particular interest, since such compounds can be used for the preparation of plastics having special properties.

Thus, for example, α-halogenoacrylic acid esters are used for the preparation of radiation-sensitive protective layers in resist technology. In particular α-fluoroacrylic acid esters are suitable, for example, for the production of plastic windows for aeronautical engineering and are suitable starting materials for polymeric optical waveguides, deuterated derivatives being of particular interest by virtue of their superior optical properties.

Hardly any syntheses of such deuterated and halogenated acrylic acid derivatives are known. The deuterated derivatives of α-fluoroacrylic acid, for example, can be prepared via the corresponding deuterotetrafluorooxetane or dideuterotetrafluorooxetane, but it is necessary to employ very expensive deuterated reagents, such as monodeuteroformaldehyde or dideuteroformaldehyde, in the synthesis of such tetrafluorooxetanes, and also to accept high losses in yield. In addition, tetrafluorooxetanes are very toxic chemicals.

It is known that the halogen atoms in many organic halogen compounds can be replaced partly or wholly by hydrogen atoms, and in some cases also by deuterium atoms, by electrochemical reduction (cf. The Chemistry of the Carbon-Halogen Bond, S. Patai (editor), Wiley, New York (1973), page 979). In these reactions the hydrogen or deuterium atoms are generally taken from the solvent.

The elimination of the halogen atoms is effected particularly easily if they are located in the vicinity of an electron-attracting functional group, for example a carbonyl group. Thus the electrochemical elimination of halogen in α,β-unsaturated carboxylic acids, for example the debromination of 2-bromofumaric acid to give fumaric acid, takes place in aqueous solutions (J. Org. Chem. 34 (1969) 3359).

However, the dehalogenation of compounds containing an acrylic acid structural unit is difficult, because various reactions which render the electrochemical reaction unselective and therefore uneconomic can take place in competition with the desired dehalogenation.

The electrochemical dehalogenation of 2,3,3-trichloropropionic acid and derivatives thereof, such as the amide, nitrile and ester, is known (cf. JACS 80, (1958), 5402), but only with the aid of polarographic analytical methods. The first step in every reaction sequence is the elimination of two vicinal chlorine atoms with the formation of a double bond. However, the resulting halogenated acrylic acid derivatives undergo secondary reactions which result in considerable losses of product if this method is used for preparation, so that this process becomes uneconomic.

For example, the intermediate product formed by the electrochemical reduction of 2,3,3-trichloropropionitrile in an electrolyte composed of 0.05M tetramethylammonium iodide in 60% strength ethanol under the conditions of polarographic analysis at a mercury cathode is 2-chloroacrylonitrile, which, however, is subsequently reduced further to acrylonitrile and then, by electrochemical hydrogenation of the C—C double bond, to propionitrile. Propionitrile itself is also attacked reductively under these conditions. The selective formation of unsaturated products is therefore not possible by this method.

A further disadvantage of this method is that, under the conditions described, products sensitive to polymerization, such as, for example, 2-chloroacrylic acid, are evidently not stable, but polymerize. Thus it is only possible to isolate a low-molecular polymeric product by the electrochemical dehalogenation of 2,3,3-trichloropropionic acid to give 2-chloroacrylic acid. This process is thus unsuitable for the preparation of 2-halogenoacrylic acids, nor can the acrylic acid itself be produced under these conditions.

In addition, the use of mercury, as is the case in the method described above, is unsuitable for industrial application because of the physical and toxicological properties of the latter. Furthermore, it is only possible to achieve unsatisfactory results when electrolyzing at mercury cathodes.

Finally, a number of electrochemical reactions (in some cases used in industry) of acrylic acids and their derivatives have been disclosed, but these are cumbersome for the specific, selective dehalogenation of halogenoacrylic acids and their derivatives:

(a) cathodic hydrodimerization (for example of acrylonitrile to adiponitrile for the preparation of intermediates for the manufacture of nylon 6,6)

(b) electropolymerization (of acrylic acid and its derivatives; this can be initiated even by the cathodic discharge of $H^+$ in sulfuric acid solution)

(c) the elimination of two vicinal halogen atoms in 2,3-dihalogenoacrylic acids and their derivatives with the formation of a triple bond.

The object arising from the state of the art was, therefore, the selective electrochemical elimination, in a technically feasible and economic process, of one or more halogen atoms from α,β-unsaturated halogenated carboxylic acids or derivatives thereof, and their replacement by hydrogen atoms or deuterium atoms, without considerable losses occurring as a result of the competitive reactions mentioned above.

It has now been found that this object can be achieved if the electrolysis is carried out in water or deuterium oxide, if appropriate in the presence of an auxiliary solvent and/or a salt of a metal having a hydrogen overvoltage greater than 0.25 volt.

The invention therefore relates to the process described in the claims.

In the process according to the invention, compounds of the formula I

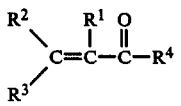

(I)

are subjected to electrolysis. In this formula:

$R^1$ is a hydrogen, deuterium or halogen atom or a methyl, deuteromethyl, nitrile, halogenomethyl or deuterohalogenomethyl group, preferably a halogen atom and particularly a fluorine atom, $R^2$ and $R^3$ independently of one another are hydrogen, deuterium or halogen atoms, the halogen atoms being preferably chlorine atoms, and $R^4$ is halogen, —OH, —OD, —OMe in which Me=an alkali metal ion, alkaline earth metal ion or $NH_4+$ ion, $C_1$–$C_{12}$-alkoxy, preferably $C_1$–$C_6$-alkoxy, nitrile or —$NR^5R^6$ in which $R^5$ and $R^6$ are identical or different and denote H, D, $C_1$–$C_{12}$-alkyl, preferably $C_1$–$C_6$-alkyl, or phenyl. $R^4$ is preferably —OH, —OD or —OMe in which Me=an alkali metal ion or $NH_4+$ ion, in particular —OH or —OD.

In this formula at least one of the radicals $R^1$, $R^2$ or $R^3$ is a halogen atom.

Suitable starting materials are, inter alia, the following compounds and also esters, amides, nitriles and salts thereof.

Perhalogenated acrylic acids, such as trichloroacrylic, tribromoacrylic and triiodoacrylic acid or 2-chloro-3,3-difluoroacrylic, 3,3-dichloro-2-fluoroacrylic, 3,3-dibromo-2-fluoroacrylic, 3,3-diiodo-2-fluoroacrylic, 2-bromo-3,3-dichloroacrylic, 3,3-dibromo-2-chloroacrylic, 3,3-dibromo-2-iodoacrylic, 3-chloro-2,3-difluoroacrylic, 2-chloro-3,3-diiodoacrylic and 2-bromo-3,3-diiodoacrylic acid or 3-bromo-2,3-dichloroacrylic, 2,3-dibromo-3-chloroacrylic, 2,3-dibromo-3-iodoacrylic, 3-bromo-2,3-difluoroacrylic, 3-bromo-2,3-diiodoacrylic, 3-bromo-2-chloro-3-iodoacrylic, 2-bromo-3-chloro-3-iodoacrylic and 3-bromo-3-chloro-2-iodoacrylic acid, preferably 3,3-dichloro-2-fluoroacrylic, trichloroacrylic, tribromoacrylic, triiodoacrylic, 3-chloro-2,3-difluoroacrylic, 3-bromo-2,3-difluoroacrylic or 3,3-dibromo-2-fluoroacrylic acid, especially 3,3-dichloro-2-fluoroacrylic or 3-chloro-2,3-difluoroacrylic acid.

Dihalogenated acrylic acids, such as 3,3-dichloroacrylic, 3,3-dibromoacrylic and 3,3-diiodoacrylic acid or 3-bromo-3-chloroacrylic, 3-chloro-3-fluoroacrylic, 3-bromo-3-fluoroacrylic and 3-bromo-3-iodoacrylic acid or 2,3-dichloroacrylic, 2,3-dibromoacrylic and 2,3-diiodoacrylic acid or 3-chloro-2-fluoroacrylic, 3-chloro-2-iodoacrylic, 2-chloro-3-fluoroacrylic, 2-chloro-3-iodoacrylic, 3-bromo-2-fluoroacrylic, 3-bromo-2-iodoacrylic, 2-bromo-3-fluoroacrylic and 2-bromo-3-iodoacrylic acid, preferably 3-chloro-2-fluoroacrylic, 3-bromo-2-fluoroacrylic and 2-chloro-3-fluoroacrylic or 2-bromo-3-fluoroacrylic acid, especially 3-chloro-2-fluoroacrylic acid.

Monohalogenated acrylic acids, such as 2-chloroacrylic, 2-bromoacrylic and 2-iodoacrylic acid or 3-chloroacrylic, 3-bromoacrylic and 3-iodoacrylic acid.

Halogenated methacrylic acids, such as 2-chloromethylacrylic, 2-bromomethylacrylic and 2-iodomethylacrylic acid or 2-dichloromethylacrylic, 2-dibromomethylacrylic and 2-chlorodifluoromethylacrylic acid or 3,3-dibromo-2-methylacrylic and 3,3-dichloro-2-methylacrylic acid or 3-chloro-2-methylacrylic and 3-bromo-2-methylacrylic acid, preferably 3-bromo-2-methylacrylic, 3,3-dibromo-2-methylacrylic, 3,3-dichloro-2-methylacrylic or 2-chloromethylacrylic acid, especially 3,3-dibromo-2-methylacrylic and 3,3-dichloro-2-methylacrylic acid.

Halogenated cyanoacrylic acids, such as 3-chloro-2-cyanoacrylic, 2-chloro-3-cyanoacrylic and 3-chloro-3-cyanoacrylic acid, preferably 3-chloro-2-cyanoacrylic acid.

The process according to the invention is carried out in divided or undivided cells. The customary diaphragms, stable in the electrolyte, composed of polymers, preferably perfluorinated polymers, or other organic or inorganic materials, such as, for example, glass or ceramics, but preferably ion exchange membranes are used to divide the cells into the anode space and the cathode space. Preferred ion exchange membranes are cation exchange membranes composed of polymers, preferably perfluorinated polymers containing carboxylic and/or sulfonic acid groups. It is also possible to use stable anion exchange membranes.

The electrolysis can be carried out in any customary electrolytic cell, such as, for example, in beaker cells or plate cells and frame cells or cells with fixed-bed electrodes or moving-bed electrodes. Either monopolar or bipolar connection of the electrodes can be used.

It is possible to carry out the electrolysis either continuously or discontinuously. A procedure in divided electrolytic cells in which the cathode reaction is carried out discontinuously and the anode reaction is operated continuously is particularly advantageous.

The electrolysis can be carried out on any cathode which is stable in the electrolyte. Materials which are particularly suitable are those having an average to high hydrogen overvoltage, such as, for example, Pd, Cd, Zn, carbon, Cu, Sn, Zr and mercury compounds, such as copper amalgam, lead amalgam and the like, and also alloys, such as, for example, lead/tin or zinc/cadmium. The use of carbon cathodes is preferred, particularly for electrolysis in acid electrolytes, since some of the electrode materials listed above, for example Zn, Sn, Cd and Pb, can suffer corrosion. In principle, any possible carbon electrode material, such as, for example, electrode graphite, impregnated graphite materials, carbon felts and vitreous carbon, are suitable as the carbon cathode. It is also possible to use electrodes composed of materials which promote catalytic hydrogenation, such as, for example, platinum or platinum/rhodium alloys.

Any material on which the anode reactions known per se take place can be used as the anode material. Examples are lead, lead dioxide on lead or other supports, platinum or titanium dioxide doped with noble metal oxides, for example platinum oxide, on titanium or other materials for the evolution of oxygen from dilute sulfuric acid, or carbon or titanium dioxide doped with noble metal oxides on titanium or other materials for the evolution of chlorine from aqueous solutions of alkali metal chlorides or hydrogen chloride.

Preferred analyte liquids are aqueous mineral acids or solutions of their salts, such as, for example, dilute sulfuric acid, concentrated hydrochloric acid or solutions of sodium sulfate or sodium chloride.

The catholyte liquids contain water or deuterium oxide.

When electrolysis is carried out in the presence of deuterium oxide, all the active protons and contained water, including water of crystallization, in the electrolyte or in the catholyte and analyte must be replaced by deuterium atoms or deuterium oxide.

One or more auxiliary solvents can be added to the electrolyte in the undivided cell or to the catholyte in the divided cell. Examples are short-chain aliphatic alcohols, such as methanol, ethanol, propanol or butanol, diols, such as ethylene glycol or propanediol, and also polyethylene glycols and ethers thereof, ethers, such as tetrahydrofuran or dioxane, amides, such as N,N-dimethylformamide, hexamethylphosphoric acid triamide, N-methyl-2-pyrrolidone, nitriles, such as acetonitrile or propionitrile, ketones, such as acetone, and other solvents. In principle, two-phase electrolysis with the addition of a water-insoluble organic solvent, such as t-butyl methyl ether or methylene chloride, in conjunction with a phase transfer catalyst is also possible.

The content of auxiliary solvent in the electrolyte or the catholyte can be 0 to 100% by weight, preferably 10 to 80% by weight, relative to the total amount of electrolyte or catholyte.

It is also possible to add to the electrolyte in the undivided cell or to the catholyte in the divided cell salts of metals having a hydrogen overvoltage of at least 0.25 volt (relative to a current density of 300 mA/cm$^2$) and/or having dehalogenating properties. Suitable salts are mainly the soluble salts of Cu, Ag, Au, Zn, Cd, Hg, Sn, Pb, Tl, Ti, Zr, Bi, V, Ta, Cr or Ni, preferably the soluble salts of Pd, Zn, Cd and Cr. The preferred anions of these salts are $Cl^-$, $SO_4^{--}$, $NO_3^-$ and $CH_3COO^-$.

The salts can be added directly to the electrolysis solution or can be formed in the solution, for example by adding oxides, carbonates etc., in some cases also the metals themselves (provided they are soluble). The concentration of salt in the electrolyte in the undivided cell and in the catholyte in the divided cell is advantageously adjusted to about $10^{-5}$ to 10% by weight, preferably about $10^{-3}$ to 5% by weight, in each case relative to the total amount of electrolyte or catholyte.

In order to adjust the pH to the value of 0 to 11, preferably 0.5 to 9, which is most favorable for the electrolysis, and in order to increase the conductivity, it is possible to add, to the catholyte in the divided cell or to the electrolyte in the undivided cell, inorganic or organic acids, preferably acids such as hydrochloric, boric, phosphoric, sulfuric or tetrafluoroboric acid and/or formic, acetic or citric acid and/or salts thereof.

The addition of organic bases can also be necessary in order to adjust the pH to the value favorable for the electrolysis and/or to have a favorable effect on the course of the electrolysis. Suitable organic bases are primary, secondary or tertiary $C_2$–$C_{12}$-alkylamines or cycloalkylamines, aromatic or aliphatic-aromatic amines or salts thereof, inorganic bases, such as alkali or alkaline earth metal hydroxides, such as, for example, Li, Na, K, Cs, Mg, Ca or Ba hydroxide, quaternary ammonium salts, having anions such as, for example, the fluorides, chlorides, bromides, iodides, acetates, sulfates, bisulfates, tetrafluoroborates, phosphates or hydroxides, and having cations such as, for example, $C_1$–$C_{12}$-tetraalkylammonium, $C_1$–$C_{12}$-trialkylarylammonium or $C_1$–$C_{12}$-trialkylalkylarylammonium, and also anionic or cationic emulsifiers, in amounts from 0.1 to 25% by weight, preferably 0.03 to 20% by weight, relative to the total amount of electrolyte or catholyte.

When electrolysis is carried out in an undivided cell, it is possible to add to the electrolyte compounds which are oxidized at a more negative potential than the halogen ions liberated, in order to prevent the formation of the free halogen. Examples of suitable compounds are the salts of oxalic acid, methoxyacetic acid, glyoxylic acid, formic acid and/or hydrazoic acid.

Electrolysis is carried out at a current density of 1 to 500 mA/cm$^2$, preferably at 10 to 300 mA/cm$^2$.

The temperature of electrolysis is within the range from −10° C. to the boiling point of the electrolysis liquid, preferably from 10° to 90° C. and particularly from 15° to 80° C.

The product of the electrolysis is worked up in a known manner, for example by extraction or by removing the solvent by distillation. The compounds added to the catholyte can thus be recycled to the process.

The process according to the invention makes it possible selectively to eliminate one or more halogen atoms electrochemically from $\alpha,\beta$-unsaturated carboxylic acids of the formula I or derivatives thereof, and to replace them by hydrogen or deuterium atoms without the occurrence of considerable losses caused by the competitive reactions mentioned above.

It is shown by means of comparison examples that selective dehalogenation is not possible under the conditions described in the publication JACS 80, 5402, 1958, that the yields are low and that it is therefore not possible to achieve an economically efficient process.

In Comparison Example A, only a low conversion of 3,3-dichloro-2-fluoroacrylic acid can be achieved in a divided cell.

In Comparison Example B, polymer and a mixture of a large number of unknown products are almost the only result of electrolysis in an undivided cell at mercury.

In Comparison Example C, the reduction of 2,3,3-trichloroacrylic acid at a mercury cathode in a divided cell gives no acrylic acid, but hydrogenated and unknown products are formed to the extent of over 50%.

The yield figures relate to the conversion of the starting material.

EXAMPLES 1 TO 11

Electrolysis conditions:

- Electrolysis cell: jacketed glass pot cell having a volume of 350 ml
- Anode: platinum grid or lead plate (20 cm$^2$)
- Cathode area: 38 cm$^2$
- Interelectrode distance: 1.5 cm
- Anolyte: dilute aqueous sulfuric acid
- Cation exchange membrane: two-layer membrane composed of a copolymer formed from a perfluorosulfonylethoxy vinyl ether and tetrafluoroethylene
- Movement of material: by means of magnetic stirrer
- Temperature: 30° C.
- Current density at cathode: 47 mA/cm$^2$
- Terminal voltage: 20 volts at the start of electrolysis, then decreasing to 5–7 volts The catholyte was worked up by exhaustive extraction with diethyl ether, and the mixture of products was precipitated as the ammonium salt by passing in ammonia or was freed from the solvent by distillation.

| | Example No. | | | | | | | | | | |
|---|---|---|---|---|---|---|---|---|---|---|---|
| | 1 | 2 | 3 | 4 | 5 | 6 | 7 | 8[2] | 9 | 10[3] | 11 |
| Cathode | Impregn. graphite | Impregn. graphite | Electrode graphite | Electrode graphite | Impregn. graphite | Impregn. graphite | Impregn. graphite | Impregn. graphite | Impregn. graphite | Impregn. graphite | Impregn. graphite |
| Starting | | | | | | | | | | | |

-continued

| Cathode | 1 Impregn. graphite | 2 Impregn. graphite | 3 Electrode graphite | 4 Electrode graphite | 5 Impregn. graphite | 6 Impregn. graphite | 7 Impregn. graphite | 8[2] Impregn. graphite | 9 Impregn. graphite | 10[3] Impregn. graphite | 11 Impregn. graphite |
|---|---|---|---|---|---|---|---|---|---|---|---|
| | Example No. | | | | | | | | | | |
| electrolyte (g) | | | | | | | | | | | |
| $H_2O$ | — | 200 | 90 | 75 | 5 | 100 | 100 | 250 | 120 | 200 | 120 |
| $D_2O$ | 200 | — | — | — | — | — | — | — | — | — | — |
| DMF | — | — | — | 14.2 | — | — | — | — | — | — | — |
| $CH_3OH$ | — | — | — | — | 20 | — | — | — | — | — | — |
| $ZnCl_2$ | — | — | — | — | — | 0.08 | — | — | — | — | — |
| $Pb(OAc)_2$ | 0.6 | 0.6 | 0.6 | 0.6 | 0.2 | — | — | 0.6 | — | 0.6 | 0.6 |
| $CdCl_2$ | | — | — | — | — | — | — | 0.8 | — | — | — |
| $Cr_2(SO_4)_3$ | — | — | — | — | — | — | — | — | 0.6 | — | — |
| Dimethylaniline | 0.1 | 0.1 | — | 0.5 | — | — | — | — | — | — | 0.1 |
| HCl (conc.) | — | — | — | — | — | — | — | — | — | 0.73 | — |
| NaOH (NaOD) | 0.44 | 0.44 | — | — | — | 0.22 | 0.32 | 0.44 | 0.5 | 0.44 | — |
| $NaHCO_3$ | — | — | 5 | — | — | — | — | — | — | — | — |
| NaOAc/HOAc | — | — | — | — | — | — | — | — | — | — | 5.1/6 |
| $KH_2PO_4$ ($KD_2PO_4$) | 2.5 | 2.6 | — | — | — | — | — | — | — | — | — |
| $K_2(C_2O_4)$ | — | — | — | — | — | — | — | 5.8 | — | — | — |
| $CCl_2{=}CF{-}COOH$ (D) | 9.15 | 5 | 2 | 2 | 2 | 2 | 2,5 | 5 | 2 | 5 | 2 |
| pH | 2.13 | 1.95 | 8.3 | —[1] | —[1] | 1.98 | 2.68 | 4.65 | 1.85 | 2.31 | 3.3 |
| Current consumed (Ah) | 20.22 | 5.06 | 2.05 | 5.3 | 0.9 | 2.03 | 4.38 | 5.05 | 3.8 | 5.06 | 1.7 |
| Electrolysis product (g)/(%) | | | | | | | | | | | |
| $CCl_2{=}CF{-}COOH$ (D) | — | — | 0.2 | — | 0.17 | 0.42 | — | 0.049 | 0.083 | 0.76 | 0.4 |
| $CHCl{=}CF{-}COOH$ (D) | 1.08*/ 15.1 | 0.32/ 8.3 | 0.884/ 62.8 | 0.84/17.4 | 0.61/ 41.9 | 0.61/49 | 0.33/17.2 | 2.07/52.7 | 0.679/ 45.5 | 1.22/36.7 | 0.9/77.5 |
| $CH_2{=}CF{-}COOH$ (D) | 4.01*/ 75.8 | 2.02/ 71.1 | 0.048/ 4.98 | 2.36/69 | 0.28/ 24.6 | 0.29/31.9 | 0.32/53.2 | 0.45/16.8 | 0.39/35.6 | 0.12/4.9 | 0.1/13.3 |
| $CH_3{-}CHF{-}COOH$ (D) | — | — | — | — | 0.05/4 | 0.014/0.1 | 0.25/17.2 | — | 0.019/ 1.7 | — | — |
| Polymeric product | — | — | — | — | — | — | — | — | 0.027 | 0.31 | — |
| pH | 1.1 | 0.77 | 7.5 | —[1] | —[1] | 1.1 | 1.55 | 3.96 | 1.5 | 1.79 | 3.01 |

[1]not determined
[2]undivided cell
[3]anion exchange membrane
*deuterated product

EXAMPLE 12

Electrolysis cell: divided plate and frame circulation cell
Electrodes: electrode graphite EH (Sigri, Meitingen) area: 200 $cm^2$
Interelectrode distance: 4 mm
Cation exchange membrane: as in Examples 1 to 11
Turbulence promoter: polyethylene grids
Catholyte:
2.5 l of water
11 g of NaOH
1 g of $Pb(OAc)_2.3H_2O$
114 g of 3-bromomethacrylic acid
Anolyte: concentrated hydrochloric acid
Terminal voltage: 8 volts at the start, decreasing to 5.6 volts
Current density: 120 $mA/cm^2$
Flow rate: 800 l/hour
Temperature: 30°-36° C.

When 40.6 Ah had been consumed, the catholyte was extracted exhaustively with diethyl ether. Removing the ether by distillation gave 54 g of crude product of the following composition:

11.93 g of 3-bromomethacrylic acid
34.5 g of methacrylic acid (65.8%)
3.5 g of 3-bromoisobutyric acid (3.4%)
4.9 g of isobutyric acid (7.5%)

The current efficiency for methacrylic acid was 60%.

EXAMPLES 13-15

The conditions of electrolysis are the same as those of Example 1.

| | 13 | 14 | 15 |
|---|---|---|---|
| Starting electrolyte (g) | | | |
| $H_2O$ | 250 | 125 | 125 |
| DMF | — | 25 | 25 |
| NaOH | — | — | 0.05 |
| KOH | 3.4 | — | — |
| $KH_2PO_4$ | — | — | 0.5 |
| HCl (conc.) | — | 3 | — |
| $Pb(OAc)_2$ | 0.6 | — | — |
| $CCl_2{=}CCl{-}COOH$ | 10 | 5 | 5 |
| pH | 3.22 | 0.9 | 3.5 |
| Current density ($mA/cm^2$) | 90 | 50-25 | 50 |
| Current consumed (Ah) | 8.03 | 6 | 6.9 |
| Electrolysis product (g)/(%) | | | |
| $CHCl{=}CCl{-}COOH$ (E,Z) | 0.81/10 | — | — |
| $CH_2{=}CCl{-}COOH$ | 3.39/55.8 | 2.553/83.5 | 0.324/8.1 |
| $CH_2{=}CHCOOH$ | — | 0.11/5.4 | 1.89/62.3 |
| $CH{\equiv}C{-}COOH$ | 0.122/3 | — | — |
| $CH_3{-}CHCl{-}COOH$ | — | 0.056/1.8 | 0.11/4 |
| $CH_3{-}CH_2{-}COOH$ | 0.044/0.7 | — | 0.074/3.5 |

-continued

| | 13 | 14 | 15 |
|---|---|---|---|
| pH | 2.12 | 0.2 | 1.1 |

EXAMPLE 16

Electrolysis conditions as in Example 1:

| | |
|---|---|
| Starting electrolyte (g) | |
| $H_2O$ | 200 |
| $Pb(OAc)_2$ | 0.6 |
| NaOH | 0.44 |
| $CHBr{=}C(CH_3){-}COOH$ | 4 (ratio 1:1.34) |
| $CH_2{=}C(CH_2Br){-}COOH$ | |
| Current consumed (Ah) | 4.86 |
| Electrolysis product (g) | |
| $CHBr{=}C(CH_3){-}COOH$ | 0.37 |
| $CH_2{=}C(CH_3){-}COOH$ | 1.23 (65.6%) |
| $(CH_3)_2CHCOOH$ | 0.15 (10.4%) |

EXAMPLE 17

Electrolysis conditions as in Example 1:

| | |
|---|---|
| Starting electrolyte | |
| $CH_3OH$ | 150 ml |
| $H_2O$ | 50 ml |
| NaOH (5% strength solution in $H_2O$) | 1.2 ml |
| $CHBr{=}C(CH_3){-}COOCH_3$ | 4 g |
| $Pb(OAc)_2$ | 0.6 g |
| pH | 7.02 |
| Current density | 70 mA/cm$^2$ |
| Current consumed | 6.55 Ah |
| Electrolysis product | |
| (the electrolyte was extracted exhaustively with pentane) | |
| $CHBr{=}C(CH_3){-}COOCH_3$ | 0.15 g |
| $CH_2{=}C(CH_3){-}COOCH_3$ | 1.28 g (60.5%) |
| $CH_2{=}C(CH_3){-}COOH$ | 0.18 g (9.9%) |
| $(CH_3)_2CH{-}COOCH_3$ | 0.1 g (5.4%) |

EXAMPLE 18

Electrolysis conditions as in Example 1:

| | |
|---|---|
| Starting electrolyte (g) | |
| $H_2O$ | 200 |
| NaOH | 0.44 |
| $Pb(OAc)_2$ | 0.6 |
| $CCl_2{=}CF{-}CN$ | 2 |
| pH | 11.93 |
| Current density (mA/cm$^2$) | 182 |
| Current consumed (Ah) | 2.3 |
| Electrolysis product (g) | |
| $CHCl{=}CF{-}CN$ | 0.094 (6.3%) |
| $CH_2{=}CF{-}CN$ | 0.328 (32.2%) |
| $CH_2Cl{-}CHF{-}CN$ | 0.22 (14.7%) |
| $CH_3{-}CHF{-}CN$ | 0.207 (19.6%) |
| pH | 2.03 |

COMPARISON EXAMPLE A

25 Electrolysis conditions:

Electrolysis cell: jacketed glass pot cell, volume 350 ml, divided

Anode: Pt grid (20 cm$^2$)

Cathode: pool of mercury (surface approx. 60 cm$^2$)

Cation exchange membrane: as in Example 1

Interelectrode distance: 1.5 cm

Temperature: 30° C.

Current density at cathode: 33 mA/cm$^2$

Terminal voltage: 50–9 volts

Anolyte: dilute $H_2SO_4$

Catholyte:

30 ml of ethanol 70 ml of water 1 g of tetramethylammonium iodide 2 g of 3,3-dichloro-2-fluoroacrylic acid Current consumed: 4.05 Ah After a current consumption of approx. 2.5 Ah, only hydrogen was formed and the composition of the catholyte did not alter further. Removing the ethanol by distillation and extracting the residue with diethyl ether gave 1.4 g of product of the following composition:

| | |
|---|---|
| $CCl_2{=}CF{-}COOH$ | 0.392 g |
| $CHCl{=}CF{-}COOH$ | 0.795 g (62.34%) |
| $CH_2{=}CF{-}COOH$ | 0.212 g (22.15%) |

COMPARISON EXAMPLE B

Electrolysis conditions:

Electrolysis cell: jacketed glass pot cell, volume 350 ml, undivided

Anode: platinum grid (20 cm$^2$)

Cathode: pool of mercury (surface approx. 60 cm$^2$)

Interelectrode distance: 1.5 cm

Movement of material: by means of magnetic stirrer

Temperature: 30+ C.

Current density at cathode: 33 mA/cm$^2$

Terminal voltage: 10–6 volts

Electrolyte:

30 g of ethanol 70 g of water 1 g of tetramethylammonium iodide 2 g of 3,3-dichloro-2-fluoroacrylic acid Current consumed: 4.05 Ah Working up as carried out by removing the ethanol by distillation and extracting the residue with diethyl ether. Removing the ether by distillation left 1.5 g of product having the following composition:

| | |
|---|---|
| $ClHC{=}CF{-}COOH$ | 0.297 g (18.9%) |
| $H_2C{-}CF{-}COOH$ | 0.008 g (0.7%) |
| Polymers and unknown products: | 1.195 g |

COMPARISON EXAMPLE C

Electrolysis conditions as in Comparison Example A:

Catholyte:

70 ml of $H_2O$ 30 g of ethanol 1 g of tetramethylammonium iodide 3 g of 2,3,3-trichloroacrylic acid Current consumed: 2.75 Ah Extracting the catholyte with diethyl ether gave 1.9 g of product having the following composition:

| | |
|---|---|
| $CHCl{=}CCl{-}COOH$ | 0.689 g (35.6%) |
| $CH_2{=}CCl{-}COOH$ | 0.173 g (9.1%) |
| $CH_3{-}CH_2{-}COOH$ | 0.258 g (13.6%) |
| unknown products: | 0.78 g (40.9%) |

We claim:

1. A process for the replacement of halogen atoms by hydrogen or deuterium atoms in an organic compound of the formula I

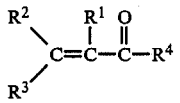

(I)

in which $R^1$ is a hydrogen, deuterium or halogen atom or a methyl, deuteromethyl, nitrile, halogenomethyl or deuterohalogenomethyl group, $R^2$ and $R^3$ independently of one another are hydrogen, deuterium or halogen atoms, and $R^4$ is halogen, —OH, —OD, —OMe in which Me=an alkali metal ion, alkaline earth metal ion or $NH_4^+$ ion, $C_1$–$C_{12}$-alkoxy, nitrile or —$NR^5R^6$ in which $R^5$ and $R^6$ are identical or different and denote —H, —D, $C_1$–$C_{12}$-alkyl or phenyl, at least one of the radicals $R^1$, $R^2$ or $R^3$ being a halogen atom, by means of electrochemical reduction, which comprises subjecting the compound of the formula I to electrolysis, in an undivided cell or a divided cell, in an electrolysis liquid composed of:

0 to 100% by weight of water or deuterium oxide, 100 to 0% by weight of an auxiliary solvent and 0 to 10% by weight of a salt of a metal having a hydrogen overvoltage of at least 0.25 volts relative to a current density of 300 mA/cm$^2$) and/or having dehalogenating properties, relative in each case to the total amount of electrolyte in the undivided cell or of the catholyte in the divided cell, at a temperature from −10° C. up to the boiling point of the electrolysis liquid and at a current density of 1 to 500 mA/cm$^2$, the cathode being composed of lead, cadmium, zinc, copper, tin, zirconium or carbon.

2. The process as claimed in claim 1, wherein the electrolysis is carried out at a pH of 0 to 11 in the electrolyte in the undivided cell or in the catholyte in the divided cell.

3. The process as claimed in claim 1, wherein 3,3-dichloro-2-fluoroacrylic acid, trichloroacrylic acid, tribromoacrylic acid, triiodoacrylic acid, 3-chloro-2,3-difluoroacrylic acid, 3-bromo-2,3-difluoroacrylic acid, 3,3-dibromo-2-fluoroacrylic acid, 3-chloro-2-fluoroacrylic acid, 3-bromo-2-fluoroacrylic acid, 2-chloro-3-fluoroacrylic acid, 2-bromo-3-fluoroacrylic acid, 3-bromo-2-methylacrylic acid, 3,3-dibromo-2-methacrylic acid, 3,3-dichloro-2-methylacrylic acid, 2-chloro-2-methylacry-lic acid or 3-chloro-2-cyanoacrylic acid is subjected to electrolysis.

4. The process as claimed in claim 1, wherein the electrolysis is carried out at a temperature from 10 to 90° C.

5. The process as claimed in claim 1, wherein the electrolysis is carried out at a current density of 30 to 300 mA/cm$^2$.

6. The process as claimed in claim 1, wherein the electrolysis is carried out in a divided cell with a discontinuous cathode reaction and a continuous anode reaction.

7. The process as claimed in claim 1, wherein the electrolysis is carried out in an undivided cell.

8. The process as claimed in claim 1, wherein the electrolysis is carried out using a cathode composed of carbon.

9. The process as claimed in claim 1, wherein a soluble salt of copper, silver, gold, zinc, cadmium, mercury, tin, lead, thalium, titanium, zirconium, bismuth, vanadium, tantalum, chromium, cerium, cobalt or nickel is present in a concentration of about $10^{-5}$ to 10% by weight, relative to the total compound of electrolyte or catholyte.

* * * * *